US006899582B1

(12) United States Patent
Hayles

(10) Patent No.: US 6,899,582 B1
(45) Date of Patent: May 31, 2005

(54) SWIFT WATER ADVANCED RESCUE DEVICE

(76) Inventor: David H. Hayles, 25907 W. Verandah Ct., Stevenson Ranch, CA (US) 91381

( * ) Notice: Subject to any disclaimer, the term of this patent is extended or adjusted under 35 U.S.C. 154(b) by 0 days.

(21) Appl. No.: 10/779,266

(22) Filed: Feb. 13, 2004

(51) Int. Cl.[7] ..... B63C 9/00
(52) U.S. Cl. ..... 441/80
(58) Field of Search ..... 441/80, 84

(56) References Cited

U.S. PATENT DOCUMENTS

| | | | | |
|---|---|---|---|---|
| 4,066,144 | A | 1/1978 | Valerio, Jr. | |
| 4,138,077 | A | 2/1979 | Okumura | |
| 4,188,000 | A | 2/1980 | Dalziel | |
| 4,204,710 | A | 5/1980 | Rothaemel et al. | |
| 4,398,760 | A | 8/1983 | Kirk | |
| 4,434,869 | A * | 3/1984 | Roop et al. | 182/10 |
| 4,642,061 | A | 2/1987 | Arney | |
| 4,652,246 | A | 3/1987 | Thorgeirsson et al. | |
| 4,678,446 | A | 7/1987 | Dahan | |
| 4,753,620 | A | 6/1988 | Arney | |
| 4,861,299 | A | 8/1989 | Ueberschaer | |
| 5,086,998 | A | 2/1992 | Pelas | |
| 5,158,489 | A | 10/1992 | Araki et al. | |
| 5,320,566 | A | 6/1994 | Low, Jr. | |
| 5,370,565 | A | 12/1994 | Yanez | |
| 5,484,313 | A | 1/1996 | Rachal et al. | |
| 5,832,547 | A | 11/1998 | Burroughs | |
| 6,475,047 | B2 | 11/2002 | Cynamon | |
| 6,520,817 | B1 | 2/2003 | Salzman | |
| 6,533,626 | B2 | 3/2003 | Pons | |
| 6,575,799 | B1 | 6/2003 | Stimpson et al. | |
| 6,604,747 | B2 | 8/2003 | Moore | |

* cited by examiner

*Primary Examiner*—Ed Swinehart
(74) *Attorney, Agent, or Firm*—Christie, Parker & Hale, LLP

(57) ABSTRACT

A rescue device with a substantially rigid support member, which support member facilitates attaching the rescue device to a number of fixtures, and which support member has an attachment portion and a receiving portion, which allows multiple such rescue devices to be connected together through their respective support members. Vertical net members are coupled to the support member and hang down from it, and horizontal net members are coupled to the vertical net members.

20 Claims, 2 Drawing Sheets

SWIFT WATER ADVANCED RESCUE DEVICE

BACKGROUND OF THE INVENTION

The present invention relates to emergency rescue devices, and more specifically, to a swift water advanced rescue device.

Emergency rescues are inherently dangerous and difficult. Such rescues, or attempted rescues, often take place in less than desirable weather conditions, and many times, it is the very nature of the weather that has caused the emergency. One particular type of emergency rescue is the rescue of victims from swiftly moving water. Such swift water emergency rescues may become necessary in a variety of situations, including on or in rivers, lakes, oceans, aqueducts and in various flood situations. Rescuing victims caught in such swift water is a difficult task. Previously, there have various attempts to fashion rescue devices to extricate victims from such swift water conditions and facilitate swift water rescues.

Traditionally, rescue of victims from swiftly moving water has been typically attempted by the use of ropes and life preservers. The life preserver was attached to a rope, and the rope attached to a structure, or held by a rescuer. The rescuer would then attempt to throw the life preserver out to the victim in the water, with the goal that the life preserver land in the immediate vicinity of the victim. Given the fast moving water, as well as the stormy weather conditions typical for such rescues, including rain and high winds, successfully implementing this method of rescue is difficult. While in ideal calm weather conditions, a skilled rescuer may be able to direct the life preserver to an area very near the victim, in typical swift water conditions, such a rescue is very difficult. The rope and life preserver must be directed with accuracy, despite the swift water current and likely windy conditions. The victim, often having substantial exposure to the water, and likely diminished strength, agility and general motor skills due to the exposure, must then grab the rope or life preserver, or even worse, attempt to swim toward the life preserver, which is likely not a stationary target due to the wind and water current. The actions required of both the rescuer and the victim for a successful rescue are extremely difficult to perform in swift water conditions. Further, if such a rescue attempt is unsuccessful, the conditions often limit the number of rescue attempts that are possible. For example, if the potential rescuer is on a bridge above the flowing water, or on a bank on one side of the water, he or she likely has only one or two attempts to make a rescue before the victim is out of reach. Typically, the rescuer may throw the life preserver once while the victim is upstream, and if unsuccessful, which is likely given the typical wind and current conditions, as well as the relatively small dimensions of the rope and life preserver combination, may then attempt to pull back in the rope and try again. By the time the life preserver has been retrieved from the errant first rescue attempt, the victim has likely passed downstream from the rescuer. Thus the second, and likely final rescue attempt must be made quickly before the victim is out of range of the rescuer's throw, adding the pressure of time to a situation already complicated by the elements. Even if a rescuer is able to successfully land the life preserver in the immediate vicinity of the victim, such a rescue device does not facilitate easy engagement with a victim. The victim has often been in the water for some time, and therefore fatigue may make even a short swim difficult. Further, the wind and current will typically keep the life preserver from remaining stationary, making it even more difficult for a victim to catch up to the life preserver. Even if the rescuer is able to land the life preserver very near to the victim, at a minimum the victim must locate the rope or life preserver, and grab on to it. The rope is relatively small, and typically not buoyant, and therefore difficult for a victim to either locate or take hold of. The life preserver, while much larger than the rope, is still relatively small. Further, it is often not easy for one struggling to stay afloat to successfully grab the life preserver. The life preserver is free to move when touched, and attempts to secure the life preserver often simply push the life preserver farther along in the water. In the hazardous conditions which seem typical of many swift water rescue attempts, such a seemingly simple task may become difficult, resulting in a literal life and death struggle by the victim to reach the life preserver and hold on to it.

An improvement to the typical rope and life preserver apparatus is the use of a combination of ropes, often in the form of a ladder. However, such ladders typically provide only a small rescue area, of only slightly larger area than the rope and life preserver combination. Such ladders typically provide no convenient method of rapid deployment, including quick yet secure attachment to a fixture. Such rope ladders also do not present a large engagement area to a victim because the rope ladders are typically not buoyant, and are likely to twist and wrap together rather than remaining spread apart in a "ladder" form.

Apparently recognizing the inherent difficulty in performing a swift water rescue with a small device such as a rope or ladder, rescue personnel have turned to the use of nets to provide a larger "rescue area" for victims to engage.

One such device is a relatively small, fixed-size net that appears to be designed for horizontal use. This net includes floats along its outside edges, as well as the center portion, to provide a floating, flat net. This implementation, while an improvement over the typical rope and life preserver, still provides a limited rescue area, and appears to suffer from the same problems, in that it appears that this device must also be accurately thrown out to the area of the victim, where the victim must then move to and take hold of the device.

A further improvement in the net-type rescue device was to hold a net in place, or attach the net to a structure or fixture, making the net, to some extent, fixed in one location. In this way, rather than both the victim and the rescue device moving in the swift water, a net may be positioned in an area to which the swift water will necessarily carry the victim.

Such nets are typically deployed across a river or aqueduct. One such device provides a net to be held by four persons, standing on opposite banks of the body of water. In many instances, deploying such a device could not be done quickly, as it would involve getting two rescuers on each bank of the body of water, and somehow getting the opposite ends of the net across the body of water. Further, it would appear that once a victim is caught in the net, if the rescue personnel are able to maintain their grip on the ropes, given the weight of the victim or victims, the swift current of the water, and any other debris caught by the net, then the rescuers on one bank (meaning now only two people, rather than four) would have to pull in the net, thereby dragging the victim across the water to the bank. In addition to the prolonged exposure in the water, the danger of submersion during such operation, and the danger to the victim of further injury by debris in the water as the victim is dragged across the water, there is also the risk of the two rescuers lacking sufficient strength to pull the victim all the way to the side, especially if other debris has become entangled in the net. While a smaller net may lessen the risk of entangling debris, it also lessens the probability of being able to catch the victim as well. Conversely, while a larger net may increase the odds of being able to catch the victim, it will also increase the odds of entangling debris, possibly injuring the victim and requiring much greater force to pull in the net.

Another device provides a large, moveable net. Rescuers would attempt to move the net laterally to the proper position to catch the person. However, such a device appears to require extensive set up, and could not be rapidly deployed in an emergency rescue type situation. Further, this device, like several others, presents a large, contiguous net portion, making it likely that the net will catch large debris, creating additional danger to persons in the water. Also, this device appears to require multiple persons to properly deploy and operate.

Another net-type device includes large weighted portions, which could be dangerous to victims in the water, making them more applicable for the removal of inanimate objects from the water. Further, as in the other devices, when the size of the net is enlarged to increase the chances of engaging the victim, the chances of engaging unwanted debris, which could damage the device, injure the victim, or both, are also increased. Finally, this device also appears to require multiple persons to properly deploy and operate.

Thus there exists the need for a swift water rescue device that provides a variable-size "rescue area" for victims to engage, which size may be adjusted as necessary depending on the particular application or situation, that allows debris to pass through, that is easily portable, that is rapidly deployable in a variety of locations, and that is easily deployed by only one person.

SUMMARY OF THE INVENTION

The present invention is embodied in a swift water advanced rescue device which may be deployed rapidly, by a single individual, may be varied in size depending on the specific application by coupling multiple devices together, and which, while providing an overall net size as large as required, is comprised of individual portions or panels, which allow larger objects to pass through rather than snagging in the net.

One aspect of a particular embodiment of the present invention is that it can be stored in a relatively small amount of space, making it extremely portable, and the device may be easily moved for use in a variety of locations and situations.

Another aspect of a particular embodiment of the present invention is that the device may be quickly and easily deployed, such as by attaching to a mounting hook, which hook slides over a structure and provides a temporary mounting means.

Another aspect of a particular embodiment of the present invention is that the device includes a secondary attachment means, for attaching the device to a structure other than a mounting hook, allowing the device to be attached, for example, to an emergency services vehicle.

Another aspect of a particular embodiment of the present invention is that rapid deployment of the device may be easily accomplished by a single individual.

Another aspect of a particular embodiment of the present invention is that it includes a substantially rigid upper support member, which allows the device to maintain its form, provides a point of attachment for connecting or securing the device to various structures, equipment or vehicles, provides a point of attachment for additional lanyards, ropes or other devices, and provides the point of connection for connecting one or more devices together.

Another aspect of a particular embodiment of the present invention is that while still easily deployable by a single individual, multiple devices may be connected together by their support members to form a large net, varying in size depending on the particular application. Each device provides a separate panel or portion of the overall net, and each device may be independently raised or lowered, such as to facilitate rescue on one portion of the net, while leaving the devices forming the remainder of the net in place to facilitate additional rescues. Because the net is comprised of a plurality of devices, rather than a single solid net, debris is able to pass through the net, and would not typically become entangled. However, should debris become lodged in the net, the ability to individually move each device will allow for the debris to be dislodged from the particular device in which it is entangled, without pulling in the entire net, thereby retaining the safety provided by the devices forming the remainder of the net.

Yet another aspect of a particular embodiment of the present invention is that the device includes one or more lanyards to allow users to more easily engage the device, and retain engagement with the device.

Yet another aspect of a particular embodiment of the present invention is that the device may include one or more buoys to provide buoyancy to specific portions of the device.

Yet another aspect of a particular embodiment of the present invention is that the device may be formed in predetermined sizes, and deployed with connections having predetermined lengths and dimensions to allow rescue personnel to train in using such device, and to deploy such device more quickly and efficiently in predetermined locations.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

The details and features of the present invention may be more fully understood by referencing the detailed description and drawings, in which.

DETAILED DESCRIPTION OF THE INVENTION

Figure 1:
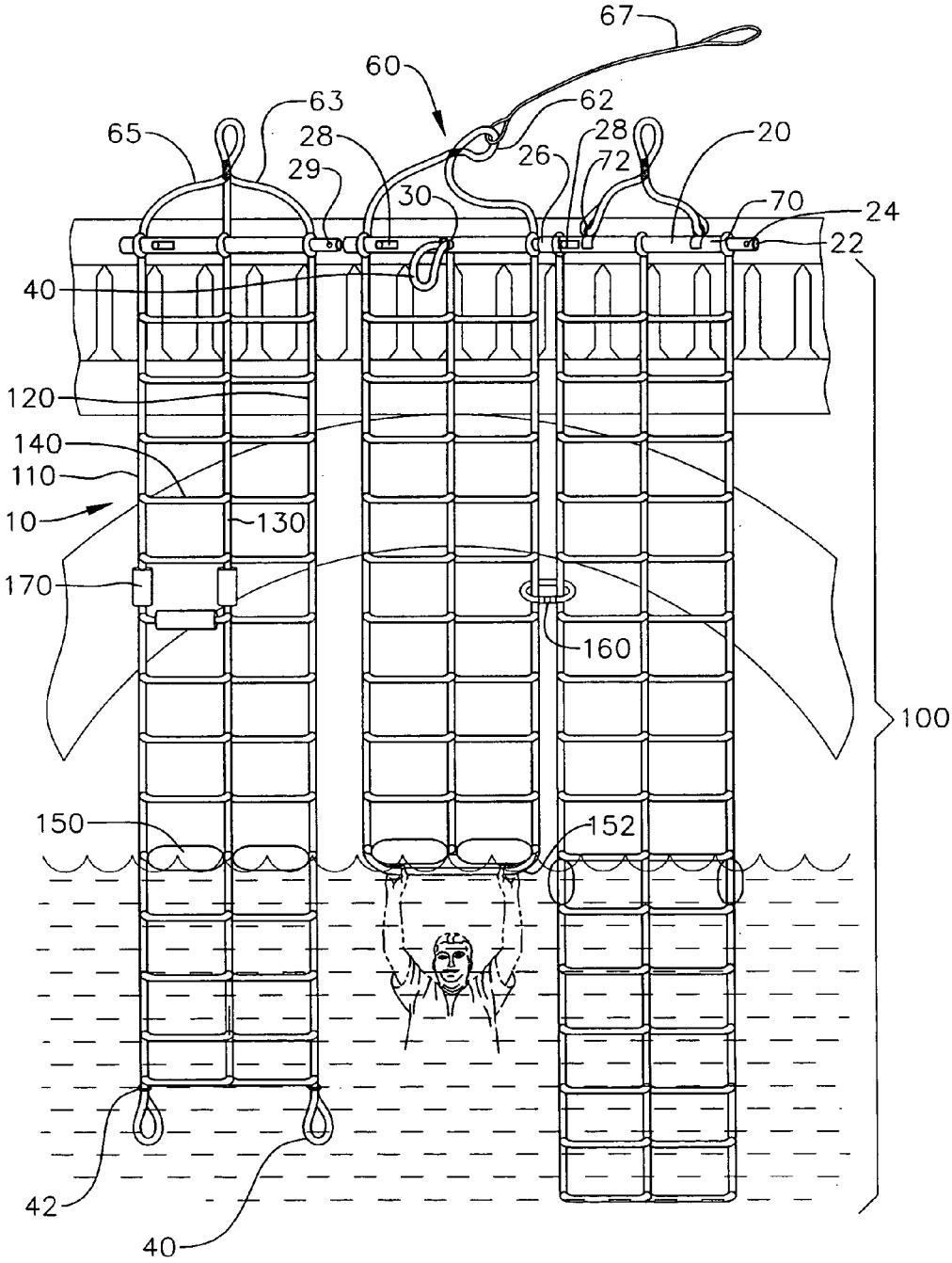
FIG. 1 is a front view of a deployment of several embodiments of the present invention.

FIG. 1 illustrates several embodiments of the swift water advanced rescue device 10 as deployed from a bridge. Many of the features of the invention are common to all of the embodiments shown, while other features shown are unique to specific embodiments of the invention. The various embodiments are shown to more clearly describe the various aspects of the invention, as they appear in differing embodiments of the invention.

The device includes a substantially rigid upper support member 20. In the embodiment shown, this member is a hollow, cylindrical steel bar. However, it will be appreciated by those skilled in the art that in other embodiments, the support member may be constructed of titanium, aluminum, or other metallic alloys, or of any material which will provide a high strength substantially rigid member, and may be hollow, partially hollow, or solid, and may be flat, round or otherwise varied in shape. In another embodiment, such as to be used during electrical storms, or when deployed near power lines, the support member 20 is constructed of a non-conductive material, such as fiberglass. In one embodiment, the support member 20 is constructed of a 1¼" fiberglass bar, with fiberglass fill. In another embodiment, the support member 20 is constructed of 2" diameter steel "grip" bar.

In the embodiment shown, the support member 20 includes an attachment portion 22, and a receiving portion 26. In one embodiment, the attachment portion 22 includes a locking tab 24, which is biased in a protruding position. Multiple devices may be attached together through the support members, which may be coupled together in a bayonet-type coupling. The attachment portion 22 of a first device is inserted into the receiving portion 26 of a second device. As the attachment portion 22 is inserted into the receiving portion 26, the locking tab 24 is forced to retract to a substantially flat position. The attachment portion is inserted, and rotated if necessary, until the locking tab 24 reaches the coupling slot 28. Once the locking tab 24 reaches the coupling slot 28, the tab 24 returns to its protruding position, thereby locking the two support members together. In one embodiment, the locking tab 24 is hemispherical in shape, and mates with coupling slot 28, which is rectangular in shape. As those skilled in the art will appreciate, in another embodiment, the locking tab 24 is rectangular in shape, and the coupling slot 28 is also rectangular in shape, having a perimeter slightly larger than that of the tab 24, such that it receives tab 24 but once received, does not allow lateral or rotational movement. In yet another embodiment, tab 24 is hemispherical in shape, and coupling slot 28 is circular in shape, of a diameter slightly larger than that of the tab 24, such that it receives tab 24 but once received does not allow lateral or rotational movement. In another embodiment, attachment portion 22 contains more than one locking tab 24, and receiving portion 26 contains more than one coupling slot 28.

In another embodiment, the locking tab is located on the receiving portion, and the coupling slot is located on the attachment portion. The attachment portion bearing the coupling slot is inserted axially into the receiving portion, where the biased-inward locking tab then mates with the coupling slot, thereby securing the connection. In another embodiment, the locking tab located on the receiving portion is a cantilever member, biased toward the axial centerline of the support member. A lever is provided to disengage the locking tab from its biased inward position, to allow support members to be connected more easily, and if desired, to keep them from locking together. In yet other embodiments, other coupling methods known to those skilled in the art are used to couple the attachment and receiving portions of support members to one another.

After one or more support members are coupled together, they may be uncoupled by forcing the locking tab 24 out of its protruding position, and applying opposite axial forces along the respective support members to pull them apart. It will be further appreciated by those skilled in the art that in another embodiment, instead of locking tab 24, the attachment portion 22 includes a slot 29 which is aligned with the coupling slot 28 in the receiving portion of a second device, and a locking pin is inserted through the respective slots 28 and 29 to couple the devices together. A cotter pin 27 maintains the locking pin in place. It will be appreciated by those skilled in the art that in other embodiments, the attachment portion 22 and the receiving portion 26 are coupled together by clamps, screws, fasteners, nut and bolt combinations, threads, and other coupling devices known to those skilled in the art.

As shown in FIG. 1, in one embodiment, the support member 20 includes port 30. This port in the support member is used as an attachment point for accessories such as a lanyard 40, ropes, or locking mechanisms.

As also shown in FIG. 1, lanyard 40 includes slide ring 42, which is slidable along the lanyard to provide additional tension, or to reduce the size of the lanyard loop, as desired. The bulk of the lanyard itself acts to retain the slide ring 42 and prevent it from sliding completely off of the lanyard. In other embodiments, the lanyard is a self-tightening type lanyard known as a beranek lanyard. In yet another embodiment, the lanyard includes a sliding Prusik knot for adjustment.

Figure 2:
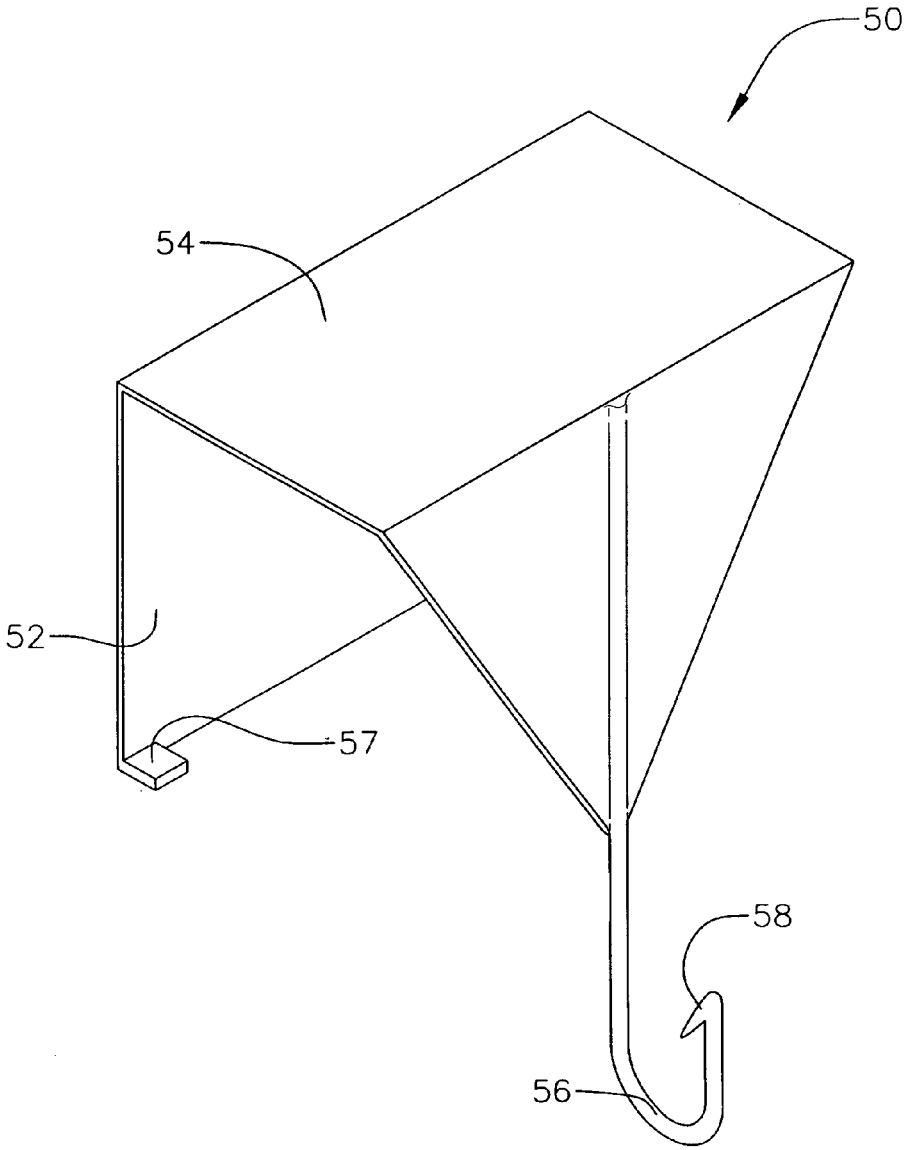
FIG. 2 is a detailed view of the connection hook of one embodiment of the present invention.

As shown in FIG. 2, connection hook 50 includes a vertical base portion 52, a horizontal base portion 54, a hook portion 56, as well as lipped hooks or tabs 57 extending substantially orthogonally from the vertical base portion 52. These tabs 57 act to retain the connection hook in place, and prevent it from moving, such as when deployed over the railing of a bridge. In the embodiment shown, a locking mechanism 58 is included. The connection hook 50 is deployed by placing it over a structure, such as a bridge railing. The vertical base portion 52 is placed on the side of the railing opposite the side the device will be deployed. The horizontal base portion rests on top of the rail, and the hook portion 56 extends on the side of the rail on which the device will be deployed.

As shown in FIG. 1, the device also includes a secondary connection means 60. This flexible connection means includes eye 62. In the preferred embodiment, connection means 60 is flexible polypropylene. However, those skilled in the art will appreciate that this connection means could also be nylon, hose, rope, cable or other known flexible connection means of sufficient strength, and that in other embodiments, the connection means is a combination of materials, having a polypropylene rope covered by a protective coating. In a preferred embodiment, the secondary connection means 60 has two sides 63, 65 of equal length, which extend from the support member 20 to the eye 62, thereby providing an anchor loop for the device. In other embodiments, the sides of the connection means are of different lengths. When being deployed in known areas or conditions, a predetermined length connector 67 is connected to eye 62 at one end, preferably with a carabiner, and connected to a preselected fixture, such as the bumper eye on a rescue vehicle, at the other end, so that the device will hang in a predetermined position. In other embodiments, the secondary connection means 60 is coupled by a carabiner to another rope or cable; in another embodiment, a rope or cable is tied to the secondary connection means. In yet another embodiment, the eye 62 of the secondary connection means 60 is reinforced for attachment to a hook, such as from a helicopter, crane or other rescue device.

In another embodiment, integral connector sleeves integral to the secondary connection means 60 couple the secondary connection means to the support member 20. In another embodiment, secondary connection means 60 is coupled to the support member 20 by forming the ends of connection means into a constrictor knot around the support member 20. In another embodiment, secondary connection means 60 is coupled to the support member 20 by passing the ends of connection means 60 through holes in support member 20. The respective portions 63, 65 of the connection means extends through the respective holes of the support member 20 from the upper side to the lower side, and on the lower side of the support member 20, the connection means is knotted, crimped or otherwise occluded from passing through the holes. In one embodiment, the connection means 60 passed through holes in the support member 20 and is secured with a figure eight follow through knot. It will be appreciated by those skilled in the art that in other embodiments, other knots are used to secure the connection means, and that other embodiments may use other methods of connection which provide a secure connection.

In another embodiment, a grappling hook with a connector is secured to a particular location, and the secondary connection means 60 is then secured to the connector of the grappling hook. In yet another embodiment, stakes are driven in a location to secure one or more lines, and the secondary connections means 60 is then coupled to the secured lines. Such embodiments are particularly useful for deployment of the device on non-uniform surfaces, or in areas lacking protruding fixtures to which devices may be easily attached.

In another embodiment, a connection harness is secured, and the secondary connection means is then coupled to the connection harness. The harness is flexible, comprising a series of ropes having first and second ends, which may be placed around virtually any structure or fixture having an opening, and then the first and second ends of the ropes are secured to each other, preferably with a carabiner, thereby securing the harness. For all references to carabiners, for additional safety, the preferred carabiner generally includes a "life lock" requiring two steps before such carabiner may be opened. However, it will be appreciated by those skilled in the art that in certain situations, a standard carabiner is used.

The secondary connection means is then connected to the harness. In another embodiment, the connection harness includes reinforcing pads to protect the ropes, and add strength. The reinforcing pads are connected to the ropes, and when deployed are in contact with the fixture or structure, located substantially between the fixture or structure and the ropes. In yet another embodiment, the harness includes additional ropes so that it may be cinched tight against the fixture or structure to which it is connected.

In another embodiment, sleeves 70 are placed over the support member 20. The sleeves contain hooks 72, to which the ends of the respective portions 63, 65 of the connection means 60 are attached. In yet another embodiment, sleeves integral to the connection means are secured to the support member.

Once the connection means is in place, the device 10 may be coupled to the connection means. In an embodiment utilizing the connection hook 50, which hook is shown in FIG. 2, the device is placed in the cradle formed by the hook 56. In one embodiment, the hook includes locking mechanism 58 which couples to the support member. In one embodiment, the locking mechanism 58 is a tang, and engages the port 30 of the support member 20, thereby coupling the support member to the connection hook. In another embodiment, the locking mechanism 58 is biased in a closed position, forming a closed loop. The mechanism is opened to receive the support member, which is placed in the cradle formed by the hook 56, then returns to its closed position, thereby locking the support member 20 in the connection hook.

In an embodiment utilizing the secondary connection means, the secondary connection means is coupled to a fixture, or to a another connector. It will appreciated by those skilled in the art that in some instances, the additional safety provided by redundancy is desired, and in one embodiment, both the connection hook and the secondary connection means are secured.

Once the device is secured, the device is easily deployed by gravity. In a preferred embodiment, the device is stored rolled up, similar to a rolled up sleeping bag, with the support member 20 on the outside of the roll. Once the support member of the device is secured, the device is simply unrolled into place. In an embodiment utilizing a plurality of devices of varying lengths and widths, deployment is similarly simple. The support member of at least one device is secured to a connection hook 50, or through the use of secondary connection means 60. Additional devices may then be coupled to the first device, and secured to additional connection means if necessary. The plurality of devices may then be unrolled. It will be appreciated by those skilled in the art that when stored, the device may be held in a rolled position by a variety of known means, such as a hook and loop fastener, rope, bungee cord, or similar device. It will be further appreciated by those skilled in the art that in another embodiment, the plurality of devices are coupled together first, then secured to the connection means, then unrolled to deploy. The embodiment chosen will depending on the specific application of the device, and the circumstances of the particular rescue.

As shown in FIG. 1, the device includes a net portion 100, comprising a plurality of horizontal and vertical members. In the preferred embodiment, the net portion is constructed of ¾" polypropylene rope, having a breaking strength of approximately 8500 lbs. However, it will be appreciated by those skilled in the art that the specific materials used will depend on the particular application for which the device is designed, and that in other embodiments, different sizes and strengths of polypropylene rope are utilized, and in yet other embodiments, other materials of differing sizes and strengths such as nylon, polyester, polyolefin, other synthetics or other polymers, or other durable materials known to those skilled in the art are used.

In one embodiment, the net portion 100 is comprised of a first outer vertical net member 110, a second outer vertical net member 120, and one or more inner vertical net members 130. In one embodiment, these vertical net members are coupled to the support member 20, in a manner similar to that previously described for the connection means 60. In another embodiment, the vertical net portions are coupled to the support member 20 by a non-slipping knot, such as a clove hitch, a constrictor knot, or any other secure knot known to those skilled in the art. In another embodiment, the vertical net members are coupled to the support member 20 by a constrictor knot, then continue upward, where all of the vertical net members are combined together to form an eye, or loop. In one embodiment, the vertical net members, or "beams" are braided together to form an eye. In another embodiment, the vertical net members are spliced together to form an eye.

A plurality of horizontal net members 140 are coupled to the outer and inner vertical net members, such that they are substantially orthogonal to such vertical members. In one embodiment, the net portion is formed from a continuous line. In another embodiment, the vertical net portions are formed with a continuous line. In yet another embodiment, the horizontal net portions are formed with a continuous line. Such use of a continuous line provides additional strength and structural integrity to the device. In one embodiment, the vertical net members and horizontal net members are coupled by knots. In a preferred embodiment, the knot is a secure knot known as a Japanese bend. It will be appreciated by those skilled in the art that in other embodiments, other knots may be preferred, and may depend on the material of the net members themselves, and that any method of substantially secure coupling known to those skilled in the art may be used to couple the vertical and horizontal net members.

In the embodiment shown in FIG. 1, flotation devices 150 are coupled to selected horizontal net members. In one embodiment, such flotation devices are coupled to the horizontal net members closest to the water line. In another embodiment, such flotation devices are coupled to the lowermost horizontal net members. In such an embodiment, a supplemental horizontal net member 152 is attached to provide an additional engagement point for a victim. In yet another embodiment, such flotation devices are coupled to a plurality of horizontal net members. In yet another embodiment, such flotation devices are coupled to selected vertical members. In a preferred embodiment, the flotation devices 150 are fender buoys made by Taylor Made Products, Gloversville, N.Y.

In another embodiment, as shown in FIG. 1, lanyards are attached to the lowermost horizontal net member to assist victims in engaging the device. In yet another embodiment, lanyards are attached to the support member 20. It will be appreciated by those skilled in the art that the location of the lanyards is varied in different embodiments depending upon the intended use, and that in some embodiments, lanyards are located at intervals along the vertical net members. In one embodiment, the lanyards are adjustable, such as beranek lanyards, or lanyards including Prusik knots for adjustment.

In a preferred embodiment, the horizontal and vertical net members are arranged to form a net having squares approximately one foot by one foot. It will be appreciated by those skilled in the art that in other embodiments, the dimensions of the net will vary, depending upon its intended use. Further, the length of the vertical net members is also varied depending upon the intended use. For example, in one embodiment designed for use from a bridge, the outer vertical net members are two feet apart, with one inner vertical net member, and all vertical net members are fifteen feet long, resulting in a net portion two feet wide, by fifteen feet long, and comprising thirty approximately one foot by one foot squares. It will be appreciated by those skilled in the art that in other embodiments, the lengths are twenty, twenty five, and thirty feet, and that in yet other embodiments, the lengths will be of a different length as needed. Similarly, in another embodiment, the width of the device is three feet, having two outer vertical net members, and two inner vertical net members, all twenty five feet in length, forming a net portion three feet wide by twenty five feet long, and having seventy five approximately one foot by one foot squares. It will be further appreciated by those skilled in the art that the width can be further varied depending on the intended application of the device, and that the number of inner vertical net member may also be varied, to change the size of the squares or rectangles formed by the vertical and horizontal net members. It will be yet further appreciated by those skilled in the art that, in one embodiment a single device is four feet wide, having two outer vertical net members, and three inner vertical net members, all being thirty feet in length, forming a net portion four feet wide by thirty feet long, while in another embodiment, two separate devices, each two feet wide, having two outer vertical net members, and one inner vertical net member, all being thirty feet in length, are attached at their support members to form a net portion four feet wide, and thirty feet long, but formed of two individual portions.

In this way, a collective net portion of a particular size may be made of a single device, or a plurality of devices. It will be appreciated by those skilled in the art that in many situations, it will be preferable to have a net portion comprised of a plurality of devices, all attached at their respective support members 20. Rather than a large contiguous net, which often traps unwanted debris, the net comprised of a plurality of devices allows debris to pass through, and if debris does become entangled in a particular device, that device may be manipulated to free the debris. Similarly, if a victim is able to engage a device, but lacks the strength to climb, the net portion of that particular device may be raised to extricate that victim, while leaving the remaining devices in their deployed position to assist other victims. In an embodiment where it is desired that the net portions of the various devices be coupled together, in addition to the coupling of the support members, carabiners 160 are used to interconnect the respective net portions. In another embodiment, the a line with an eye or loop at each end is coupled to the bottom of the net portion 100, preferably by coupling the eye to the net portion with a carabiner, the line is passed through adjacent squares of the adjacent net portions of adjacent devices, "sewing" the devices together, and the line is then coupled to an upper portion of the net portion 100. The net portions are easily disconnected by uncoupling the carabiner coupling the line to the bottom of the net portion, and pulling the line up through the net portions, thereby uncoupling the net portions of the devices.

In one embodiment, the net portion of the device is colored for maximum visibility. In another embodiment, the net portions of devices of different dimensions are color coded to represent specific length and width combinations, so that particular length and/or width devices may be easily and rapidly identified in emergency situations. In yet another embodiment, the net portions of the device are colored to represent the strength of the device.

In another embodiment where additional rigidity is desired in the net portion of the device, a sleeve 170 is attached over at least one portion of an outer vertical net member. In one embodiment, the sleeve is a plastic sleeve. It will be appreciated by those skilled in the art that in other embodiments, the sleeve is constructed of rubber, fiberglass, or any other material known to the those skilled in the art to add sufficient rigidity. It will be further appreciated by those skilled in the art that in an embodiment where further rigidity is required, such a sleeve 170 is attached over at least one portion of a horizontal net member. In another embodiment where even further rigidity is required, sleeves are attached over at least one portion of a vertical net member, and over at least one portion of a horizontal net member.

In another embodiment, the device may be used as a permanent safety ladder or net. In this embodiment, weight may be coupled to the lowermost horizontal net member, or the lowermost horizontal net member may be coupled to a fixture to retain the device in a fixed position. In yet another embodiment, the lower portion of the vertical net members is coupled to a fixture to retain the device in a fixed position. In yet another embodiment, an additional substantially rigid support member is place at the lower portion of the device, coupled to the vertical net members in a manner similar to the upper portion of the device, allowing the device to be secured to a fixture at both ends. This embodiment allows the invention to be used in a non-horizontal orientation, and may be helpful in a variety of high-speed applications, as well as in zero-gravity applications. In another embodiment, applicable to zero-gravity or underwater situations, the vertical and horizontal net members comprise a heavy material, such that they will be negatively buoyant when underwater.

It will be appreciated by those skilled in the art that the present invention may be used in a variety of rescue situations, as well as to provide safety in various working conditions. In another embodiment, the device may be used outside the context of a swift water rescue, and may be deployed along scaffolding, docks, boats, or any other location where such infinitely sizable and easily deployable safety netting is required. In yet another embodiment, the invention is used for rescue in ice and snow conditions.

In another embodiment, applicable to dock or wharf applications, a permanent connection means is mounted to the dock or wharf. This means could be a flange, hook, series of loops, cradle, or other means known in the art for receiving the support member of the device. In another embodiment, designed for permanent use, the net portion is comprised of reinforced materials, and the horizontal and vertical net members comprise rope reinforced by a core of wire or cable.

In another embodiment, a device of the present invention is used as safety netting, such as on or around construction sites. The device is coupled to a flexible sheet member, such as a tarp, on one side, to prevent debris from passing through the device, while the net members provide a secure climbing device on the other side. Such an embodiment is particularly well-suited to use covering construction scaffolding, where the net members are faced toward the scaffolding, for use by workers, and the flexible sheet members are faced toward the outside, to contain debris within the scaffolding and protect those outside of it.

Although the invention has been described in detail with reference only to the preferred embodiments, those having ordinary skill in the art will appreciate that various modifications, including modifications to shape and size, can be made without departing from the spirit and scope of the invention. Accordingly, the invention is defined with reference to the following claims.

What is claimed is:

1. A portable rescue device, adapted for rapid deployment comprising:

a substantially rigid support member having an attachment portion and a receiving portion and adapted to be coupled to at least one other substantially rigid support member;

a first outer vertical net member coupled to the support member;

a second outer vertical net member coupled to the support member;

at least one inner vertical net member coupled to the support member;

a plurality of horizontal net members coupled to the inner and outer vertical net members and substantially orthogonal thereto; and a connection means for coupling the support member to a fixture, the fixture located substantially within a volume bounded by a plane of the first outer vertical net member that is orthogonal to the plane of the device and a plane of the second outer vertical net member that is orthogonal to the plane of the device.

2. A rescue device as in claim 1, wherein an upper portion of the vertical net members extends substantially beyond the support member, and wherein the upper portions of the respective vertical net members are coupled together to form the connection means.

3. A rescue device as in claim 1, wherein the connection means is a rope.

4. A rescue device as in claim 1, further comprising a second connection means for coupling the support member to a fixture.

5. A rescue device as in claim 1, wherein a continuous member is adapted to form the vertical net members.

6. A rescue device as in claim 1, wherein the vertical and horizontal net members are colored to represent the size of the rescue device.

7. A rescue device as in claim 1, wherein the vertical and horizontal net members are colored to represent the strength of the rescue device.

8. A rescue device as in claim 1, wherein the connection means permanently couples the device to a fixture.

9. A rescue device as in claim 1, wherein the connection means comprises a first sleeve and a second sleeve about the support member.

10. A rescue device as in claim 1, further comprising at least one lanyard coupled to the support member.

11. A rescue device as in claim 1, further comprising at leant one lanyard coupled to a vertical net member.

12. A rescue device as in claim 1, further comprising at least one lanyard coupled to a horizontal net member.

13. A rescue device as in claim 1, further comprising at least one flotation device coupled to the device.

14. A rescue device as in claim 1, further comprising at least one sleeve enclosing at least a portion of a vertical net member.

15. A rescue device as in claim 1, further comprising at least one sleeve enclosing at least a portion of a horizontal net member.

16. A rescue device as in claim 1, further comprising:

at least one lanyard coupled to a net member; and at least one flotation device coupled to a net member;

wherein the rescue device is adapted for substantially vertical deployment.

17. A rescue device as in claim 16, wherein the vertical and horizontal net members comprise polypropylene.

18. A method of rescuing persons from a body of water, comprising:

locating an existing structure above the body of water;

securing a connection means for connecting a rescue device to the structure;

attaching a rescue device to the connection means, wherein the rescue device comprises a substantially rigid support member, a plurality of vertical net members, and a plurality of horizontal net members, where the vertical net members are coupled to the support member and the horizontal net members are coupled to the vertical net members; and deploying the rescue device by releasing the vertical net members such that the rescue device is hanging in a substantially vertical orientation from the structure.

19. A rescue device, comprising:

a first substantially rigid support member having an attachment portion and a receiving portion and adapted to be coupled to at least one other substantially rigid support member;

a first outer vertical net member coupled to the first support member;

a second outer vertical net member coupled to the first support member;

at least one inner vertical net member coupled to the first support member;

a plurality of horizontal net members coupled to the first and second outer vertical net members and to the inner vertical net member and substantially orthogonal thereto;

a second substantially rigid support member having an attachment portion and a receiving portion, the receiving portion of the second support member coupled to the attachment portion of the first support member;

a third outer vertical net member coupled to the second support member;

a fourth outer vertical net member coupled to the second support member;

at least one inner vertical net member coupled to the second support member;

a plurality of horizontal net members coupled to the third and fourth outer vertical net members and to the inner vertical net member and substantially orthogonal thereto; and at least one connection means for coupling the first or second support member to a fixture.

20. A rescue device as in claim 19, wherein at least a portion of the first or second outer vertical net member is coupled with at least a portion of the third or fourth outer vertical net member.

* * * * *